United States Patent [19]

Benaim

[11] Patent Number: 4,657,248

[45] Date of Patent: Apr. 14, 1987

[54] QUESTION-AND-ANSWER GAME

[76] Inventor: Prosper Benaim, 8 Cadman Street, Dollard des Ormeaux, Province of Quebec, Canada, H9B 1X5

[21] Appl. No.: 763,291

[22] Filed: Aug. 7, 1985

[51] Int. Cl.[4] ..... A63F 9/18

[52] U.S. Cl. ..... 273/1 R; 434/348; 434/327; 446/487

[58] Field of Search ..... 273/1 R; 434/327, 331, 434/348, 167; 446/487

[56] References Cited

U.S. PATENT DOCUMENTS

| | | | |
|---|---|---|---|
| 1,868,823 | 7/1932 | Goodrich | 434/327 |
| 2,971,268 | 2/1961 | Zimmerman | 434/167 |
| 3,097,435 | 7/1963 | Goldschmidt | 434/348 |
| 3,359,651 | 12/1967 | Mair | 434/331 |
| 3,530,614 | 9/1970 | Strongin | 446/487 |
| 3,780,451 | 12/1973 | White | 434/347 |
| 4,095,366 | 6/1978 | Buck et al. | 446/487 |
| 4,250,633 | 2/1981 | Thompson | 434/327 |

FOREIGN PATENT DOCUMENTS

| | | | |
|---|---|---|---|
| 2261793 | 5/1975 | France | 446/487 |

*Primary Examiner*—Paul E. Shapiro

[57] ABSTRACT

Matching question and answer cards in combination with a pair of pivotally interconnected rectangular >>flip-flop<< plates. The question card bears near the top the letters forming the answer to the question out of the proper sequence, and also bears pictorial representations giving clues to the proper answer. The question card also bears at the central location the same letters in the proper sequence, but intermingled with other letters. The answer card is adapted to be superposed on the question card and bears further clues more explicit than the first-named clues, and a series of holes in its center portion to register with the letters forming the right answer on the question card, so that the proper answer appears through the holes. The two plates are pivotally interconnected by opaque flexible tapes so that the plates can be successively pivoted in the same direction alternately about their opposite ends; the inner face of one plate has a recess and a transparent panel forming two gaps for removable insertion of the two cards in superposed position. The player inserts a question card into the recess of the plate and tries to figure out the answer from clues. If, after a certain time he does not find the answer, he takes the answer card. If he does not yet find the proper answer, he inserts the answer card over the question card and flips the two plates twice to expose the answer through the holes of the answer card.

6 Claims, 12 Drawing Figures

FIG. 1
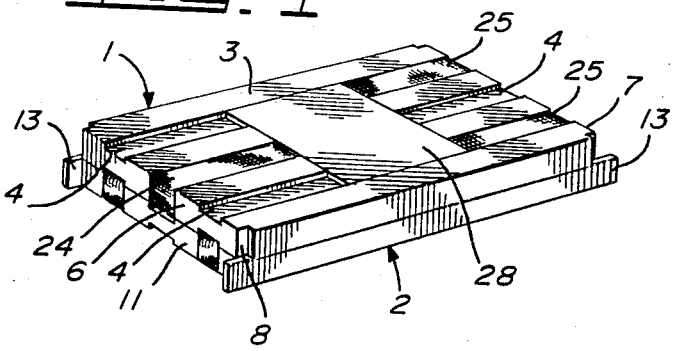
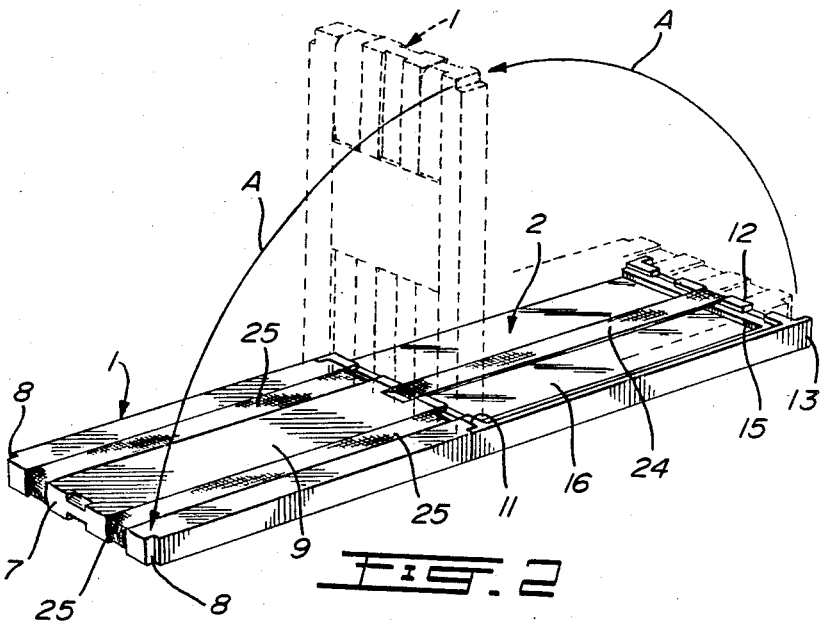
FIG. 2

FIG. 3
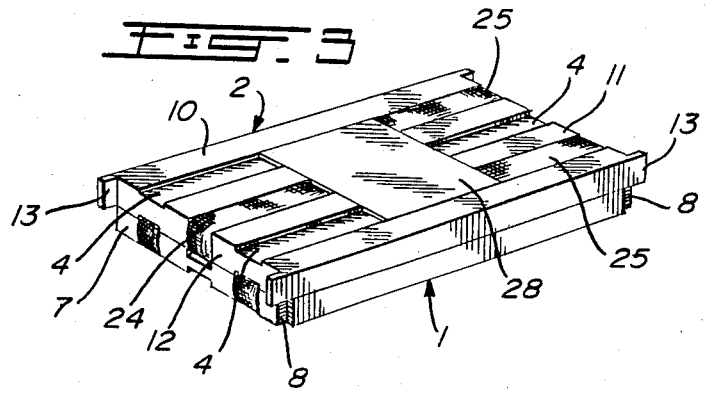
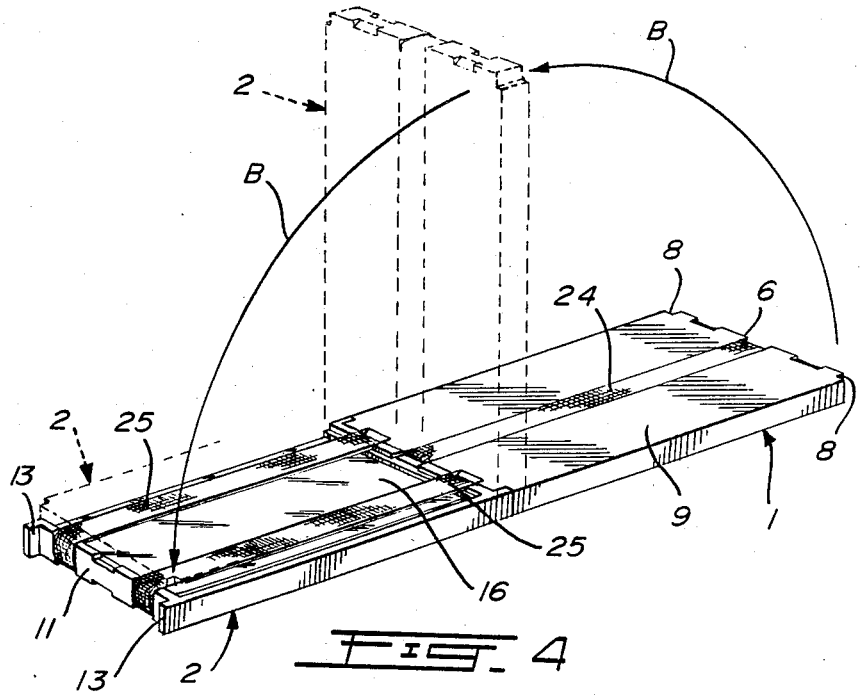
FIG. 4

QUESTION-AND-ANSWER GAME

FIELD OF THE INVENTION

This invention relates to question-and-answer games.

BACKGROUND OF THE INVENTION

Flip-flop blocks per se are well known in the art. Furthermore, question-and-answer games with slide-in question cards are also old, such as in U.S. Pat. Nos. 3,780,451, issued Dec. 25, 1973 to William White and 4,250,633, issued Feb. 17, 1981 to Donald Thompson.

In White, a housing is provided into which may be engaged cards 20 at one end. The opposite faces of the housing have windows 44A and 44B through which are visible a question and the corresponding answer respectively.

In Thompson, there is further provided a mechanism to rotate the card at 180°.

It would be desirable to provide means that allows decreasing levels of mental efforts to recall answer to the question, with, of course, appropriate progressive decreases in whatever reward is associated with a correct answer given by the player himself before the statement of answer on the answer card can be read.

The present invention is directed to the meeting of this purpose and proposes a new tool to obtain this goal.

OBJECTS OF THE INVENTION

The gist of the present invention is to provide a question-answer game that will allow progressive levels of partial answer types of information, associated with decreasing levels of corresponding rewards.

An object of the above invention is that the question-answer game be embodied in an assembly which will stimulate playfulness.

An object of the above invention is that the question-answer game be easy to use and be of simple and sturdy contruction.

SUMMARY OF THE INVENTION

The question-and-answer game of the invention comprises a question card bearing at a first location the letters forming the answer to the question out of proper sequence, and also bearing at a second location the same letters in the proper sequence, but intermingled with other letters; an answer card adapted to be superposed on said question card with third and fourth locations overlying said first and second locations, respectively, when said answer card is superposed on said question card, said answer card bearing at said third location data giving first clues to help in arriving at the proper answer and having a series of holes at said fourth location registering only with said same letters at said second location, whereby the proper answer appears through said holes; first and second plates each having an inner and an outer face, said first plate inner face provided with means for positioning said cards thereon in superposed position, flexible opaque tapes interconnecting said plates and permitting successive pivoting of the two plates in the same direction alternately about their opposite ends, said tapes including a first tape portion masking said holes in a first pivoted position of said plates, wherein said inner faces are exposed and both said cards are in said superposed position, said tape portion transferred to and overlying the inner face of the second plate in a second pivoted position of said plates, wherein said inner faces are again exposed, whereby said tape portion unmasks said holes.

BRIEF DESCRIPTION OF THE DRAWINGS

FIG. 1 is a downwardly-looking perspective view of the game device in its closed position;

FIG. 2 is a perspective view of the same device in which the top plate has been pivoted through 180° in one direction and showing the inner face of one plate provided with a recess for receiving question-and-answer cards;

FIG. 3 is a perspective view of the closed device with the card-carrying plate again pivoted through 180° from the position sohown in FIG. 2 and in the same direction;

FIG. 4 is a perspective view of the open device shown in a second open position, wherein the card-bearing plate has again been pivoted through 180° from the folded position of FIG. 3;

DETAILED DESCRIPTION OF THE PREFERRED EMBODIMENT OF THE INVENTION

Figure 5:
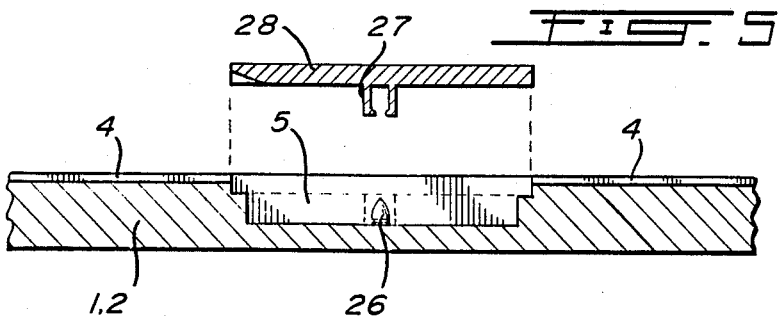
FIGS. 5 and 6 are cross-sections of either one of the two plates showing the means to secure the ends of the tapes to the plates at their outer faces, with the cover removed in FIG. 5 and in position in FIG. 6.
Figure 7:
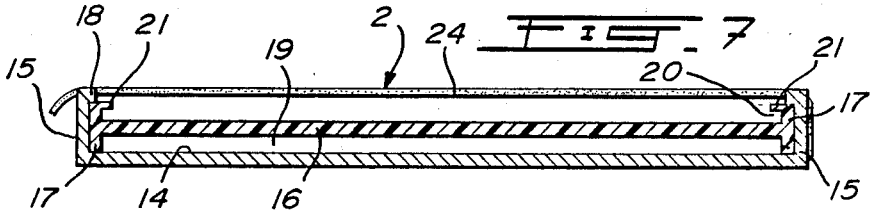
FIG. 7 is a longitudinal section of the card-bearing plate.
Figure 8:
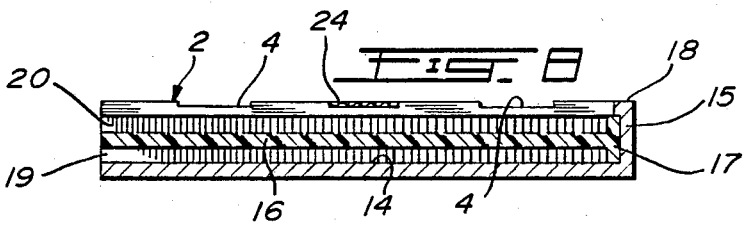
FIG. 8 is a cross-section of the card-bearing plate.
Figure 9:
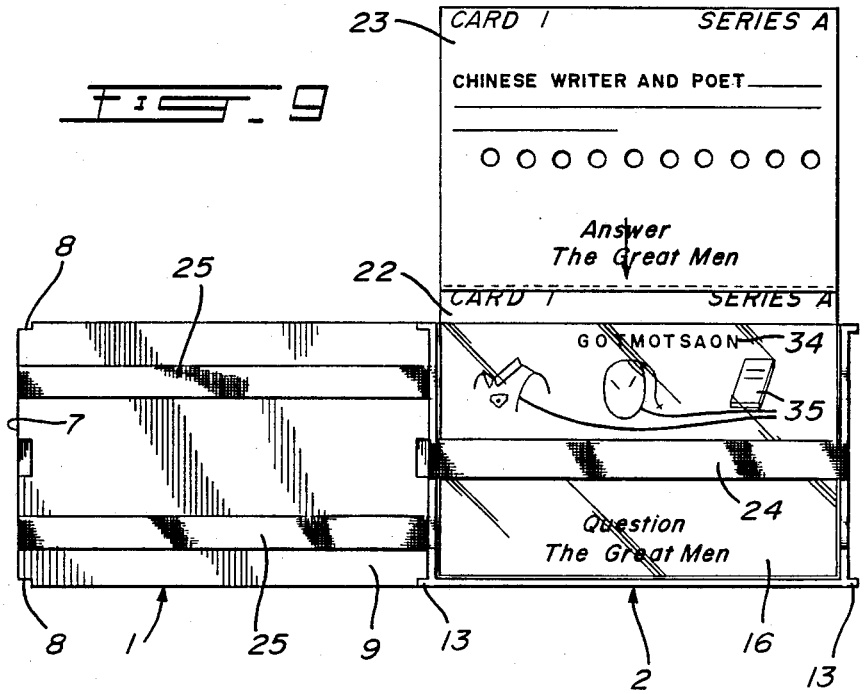
FIG. 9 is a plan view of the open plates in the open position, shown in FIG. 2, and with a question card inserted in position and an answer card about to be inserted over the question card.

Referring to FIGS. 1 to 4, the device comprises two rigid, rectangular plates 1 and 2, plate 2 being denoted a card-carrying plate. Plate 1 has an outer face 3 provided with three longitudinal grooves 4 joining with a central recess 5, made in the outer face 3 (see FIGS. 5 and 6), and terminating at the end edges 6 and 7 of plate 1, there being provided end notches 8 at each of the four corners of the plate 1. The inner surface 9 of plate 1 is flat, as shown in FIG. 2. Card-carrying plate 2 has an outer surface 10, also provided with longitudinal grooves 4 communicating with a central recess 5 and having end edges 11 and 12, respectively, with end projections 13 at the four corners of the plate 2 adapted to match with and enter notches 8 of the plate 1. As shown in FIG. 2 and also in FIGS. 7 and 8, card-carrying plate 2 has an inner face forming a recess defined by a bottom surface 14 and upstanding peripheral flanges 15 extending on three sides of plate 2. A transparent panel 16, for instance made of plastic material, is inserted within the recess, said panel having at three sides of its periphery oppositely-extending ribs 17 engaging the bottom face 14 and a shoulder 18 formed by the peripheral flanges 15. Thus, there is provided a first gap 19 defined between bottom face 14 and the transparent panel 16, for the removable insertion of a question card, and a second gap 20 defined between the panel 16 and a pair of inwardly-extending flanges 21 for the insertion and removal of an answer card, the question card being indicated at 22 and the answer card being indicated at 23 in FIGS. 9 and 10, respectively. Flexible opaque tapes 24 and 25 are provided to pivotally interconnect the two plates 1 and 2 for successive pivotal movement in the same direction about alternate end edges 6 and 11 and then 7 and 12 of the plates, as is known in conventional flip-flop plates. Tape 24 extends along the centerline of the elongated plates 11 and 2 in the following manner.

Figure 6:
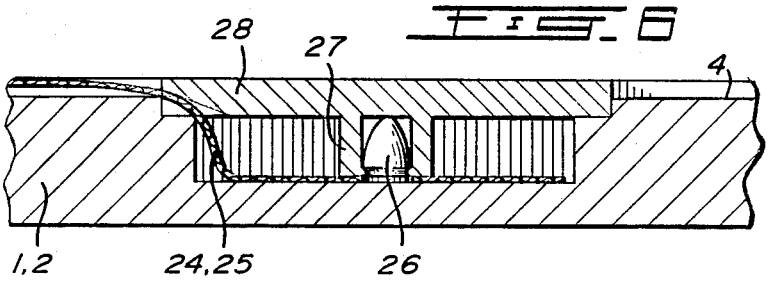

One end of tape 24 is engaged within the recess 5 at the outer face of plate 1, as shown in FIG. 6, and pierced by and retained by a pointed male connector 26 protruding from the bottom surface of recess 5; said male connector is adapted to engage the female connector 27 of a cover 28, connectors 26, 27 forming a snap connection to removably retain the cover 28 within recess 5 with the tape 24 sandwiched between the female connector 27 and the bottom face of recess 5.

Referring to FIGS. 1 and 2, the tape 24 extends from its attached end under cover 28 along the central one of the grooves 4, then around the end edge 6 of plate 1, then longitudinally over the central portion of the inner face of plate 2, then around end edge 12 of plate 2; finally within the central one of the grooves 4 at the outer face of plate 2 to be finally attached within recess 5 at the outer face of plate 2 between the female connector 27 and the bottom surface of said recess 5.

It is noted that there is a recess 5 with a cover 28 and male and female connectors 26, 27 of identical construction, at the outer face of both plates 1 and 2.

Again referring to FIGS. 1 and 2, there are provided also two flexible opaque tapes, the first ends of which are attached by additional male and female connectors 26, 27 for cover 28, and each extending within one of the outer grooves 4 in a direction opposite the tape 24 at the outer surface of plate 1; then around edge 7 of plate 1; then overlying the inner face 9 of plate 1; then crossing over between an edge edge 6 of plate 1 and edge 11 of plate 2, to the outer face of plate 2 where, as shown in FIG. 3, the opposite ends of said plates 25 enter the recess 5 of plate 2 and are pierced and retained by the additional male and female connectors 26 and 27 retaining cover 28 on the outer face of plate 22. With this arrangement, it is seen that from the position shown in FIG. 1, opening movement of plate 1 through 180°, as indicated by the arrow A in FIG. 2, exposes the inner face of card-carying plate 2 on the left-hand side of the assembly of plates. In this position, it is noted that tape 24 has a portion extending along the central longitudinal portion of the inner face of card-carrying plate 2, that is over transparent panel 16 and the second gap 20.

From the position of FIG. 2, the outer panel 2 may be pivoted again in anticlockwise direction in the direction of arrow A, to the position shown in FIG. 3, and the same card-carrying plate 2 may be again rotated to the position of FIG. 4, in accordance with arrow B, wherein the inner face of plate 2 is again exposed, but on the left-hand side of the assembly, and with the central tape 24 having been transferred to the inner face of plate 1 and unmasking the central area of the inner face of plate 2.

Advantage is taken, in accordance with the invention of the alternate masking and unmasking of the central area of the inner surface of plate 2.

Referring to FIGS. 9 to 12, there will be several sets of question cards 22 and corresponding answer cards 23 all assembled in several series of such sets of cards. Several series are provided on different educational topics, with several sets of cards in each series, for instance the topics may be the Great Men, the Great Discoveries, the Bible, Botany Sports, the Capitals, the Great Cities, the Great Men of the Theater, etc. Any number of topics may be addressed. In each series, there will be several cards numbered in consecutive order. In the example shown, the number of the series of the sets is indicated at 29 as series A for both the answer-card 23 and the question-card 22, while the matching card number is indicated at 30 as card 1 for both cards. The topic of the series is indicated at 31 on both cards, and both cards are characterized by the term >>answer<< at 32 and >>question<< at 33.

The question-card 22 bears a question, indicated at 34, near the top edge thereof, said question consisting of all the letters forming the right answer but written out of proper sequence. Just below the question 34, pictorial representations 35 are marked on the question-card 22, constituting clues to help the player to arrive at a proper answer.

In the specific example given, the question 34 consists of the letters written out of proper sequence forming the name of Maotsotong, the pictures or representations 35 showing a military uniform, a Chinese head and a book.

Figure 10:
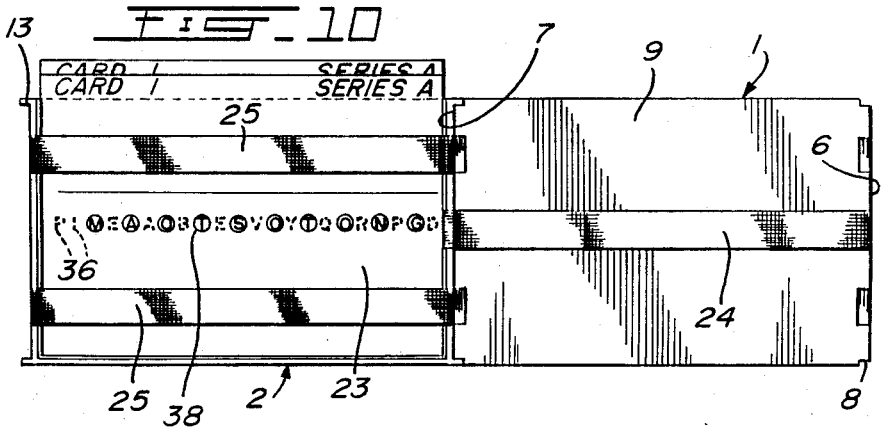
FIG. 10 shows the same arrangement, with the two cards in overlying registering position and pivoted to the final position illustrated in FIG. 4.
Figure 11:
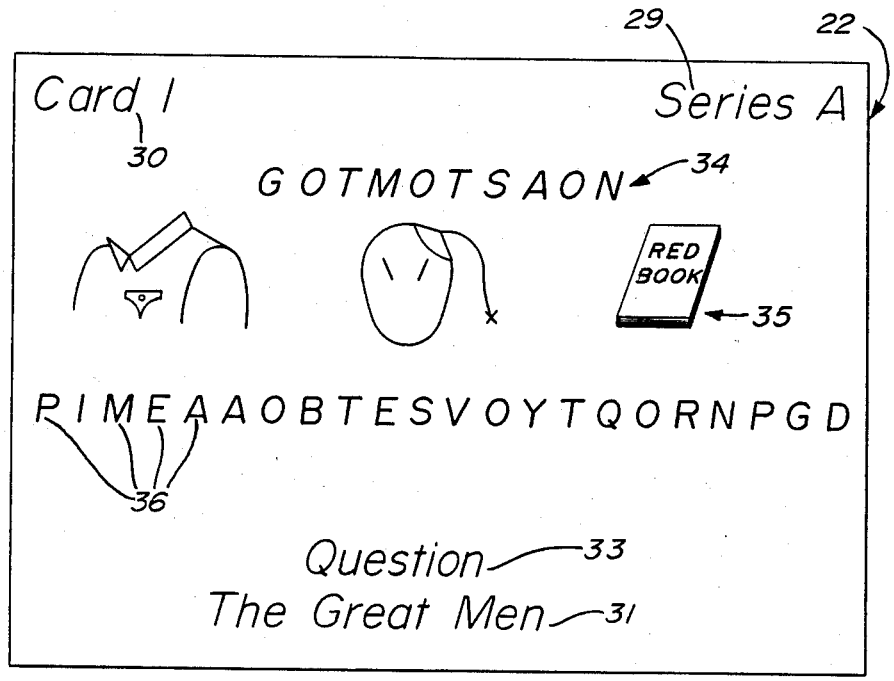
FIGS. 11 and 12 are plan views of a question card and matching answer card, respectively.
Figure 12:
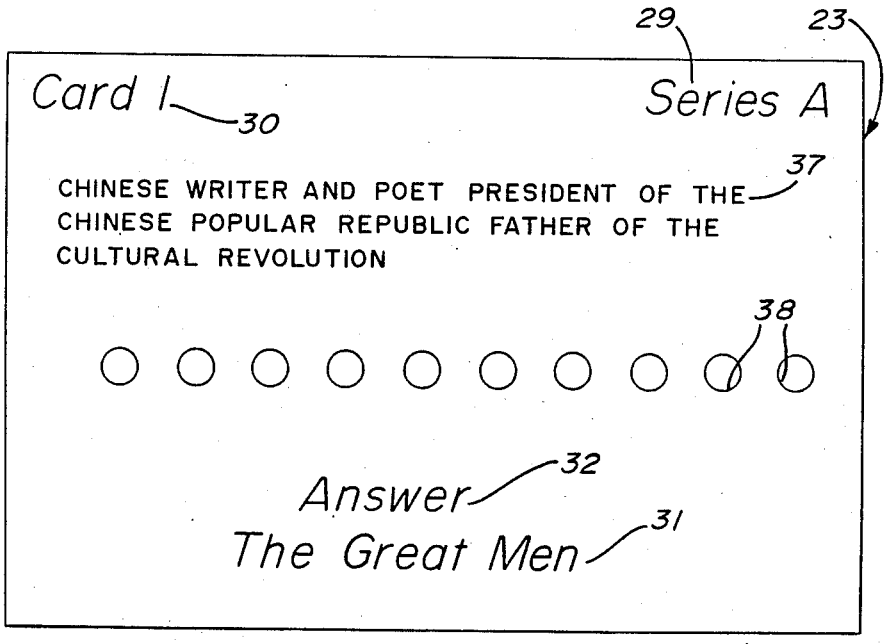

Along the central portion of the question card 22 and masked by the tape 24, when the device is in the pivoted position of FIG. 2, there are written a series of letters, as shown in FIG. 10, which comprise the letters forming the answer to the question and written in the proper sequence, but intermingled with additional letters 36. The answer-card 23 carries at the top thereof written data, as shown at 37, giving more explicit clues to reach the right answer; than the pictorial data 35 appearing on question-card 22. For instance, in the answer-card illustrated, data 37 may read >>Chinese writer and poet, president of the Popular Republic of China—Father of the Cultural Revolution. Below data 37 and disposed along the central longitudinal portion of the card 23, there are provided a series of holes or perforations 38, which, when the answer-card 23 is superposed in register with the question-card 22, will register with only the letters of the central area of the question-card forming the right answer, as shown in FIG. 10, wherein the word >>Maotsotong<< appears, the additional letters 36 remaining hidden.

The game is played as follows. A particular series of cards is selected, for instance series A and entitled >>The Great Men<<. A player first draws a question-card, for instance card 1 of the series and inserts this card in the gap 19 at the inner face of card-carrying plate 2, whereby the central tape 24 masks the letters composing the answer together with the additional letters 36 interspersed between said letters. The player is given a fixed time, for instance with the use of an hour-glass, to formulate the right answer, having as clues the letters composing the right answer but written in out-of-proper sequence, and also pictorial representations 35 giving clues. If he reaches the right answer in the allocated time, he can mark for himself, for instance, 100 points. If he has not attained the proper answer within the allocated time, he draws the corresponding answer-card 23 where he can read the additional and more explicit clues 37. He is again given a certain time to formulate the answer. A right answer will give, for instance, 50 points. If he has not reached the proper answer this second-time around, he inserts the answer-card 23 within the second gap 20 in overlying and registering relationship with the question-card 22; then he flips the card-bearing plate 2 twice through 180° in the same direction, to the the final arrangement, as shown in FIG. 10, wherein the proper answer appears through the holes 38 of the answer-card. In this case, the player is not allocated any points.

What I claim is:

1. A question-and answer game comprising, in combination, a question card bearing at a first location the letters forming the answer to the question out of proper sequence and also bearing at a second location the same letters in the proper sequence, but intermingled with other letters, an answer card adapted to be superposed on said question card with third and fourth locations overlying said first and second locations, respectively, when said answer card is superposed on said question card, said answer card bearing at said third location data giving first clues to help in arriving at the proper answer and having a series of holes at said fourth location registering only with said same letters at said second location, whereby the proper answer appears through said holes, first and second plates each having an inner and an outer face, said first plate inner face provided with means for positioning said cards thereon in said superposed position, flexible opaque tapes interconnecting said plates and permitting successive pivoting of the two plates in the same direction alternately about their opposite ends, said tapes including a first tape portion masking said holes in a first pivoted position of said plates, wherein said inner faces are exposed and both said cards are positioned on said first plate inner face, said tape portion transferred to and overlying the inner face of said second plate in a second pivoted position of said plate, wherein said inner faces are again exposed, whereby said tape portion unmasks said holes.

2. A question-and-answer game as defined in claim 1, wherein said question card bears at said first location pictorial representations giving second clues to help in arriving at the proper answer, said second clues being less explicit than said first clues.

3. A question-and-answer game as defined in claim 2, wherein said second and fourth locations are located in the central portion of said question card and answer card, respectively, and wherein said flexible tapes include a first tape and a pair of second tapes, said first tape providing said tape portion and having one end secured to the central portion of the outer face of said first plate passing around the outer edge of and along the inner face plate in said pivoted position of said two plates; then crossing between the inner edges of the two plates and having its other end secured to the central portion of the outer face of said second plate, again in said first pivoted position of said plates, said second tapes having first ends secured to the outer face of said second plate on each side of said first tape passing around the outer edge of said second plate, around the inner face of said second plate crossing between the inner adjacent edges of the two plates and secured at their opposite ends to the outer face of said first plate on each side of said first tape, again in the first pivoted position of said two plates.

4. A question-and-answer game as defined in claim 3, further including means to secure the outer ends of said tapes to the outer faces of said first and second plates, including a recess formed at the outer face of each plate, each defining a bottom face, a cover removably insertable within said recess, a snap connector assembly to removably retain said cover in position within said recess, said assembly including pointed male connectors protruding from said bottom face of said recess and adapted to pierce the ends of said tapes.

5. A question-and-answer game as claimed in claim 4, further including projections at the four corners of said one plate and notches at the four corners of the other plate to matingly, hingedly engage with said projections.

6. A question-and-answer game as defined in claim 5, wherein said first plate inner face defines a recess formed by a peripheral flange extending along three sides of said plate, the remaining side being devoid of such flange, and further including a transparent panel located in said recess and defining a first gap between the bottom surface of said recess and said transparent panel, and a second gap between said transparent panel and said portion of said first tape, said two gaps accessible from the outside through the portion of said first plate devoid of said flange for insertion and removal of said answer-and-question cards within and from said first and second gaps, respectively.

* * * * *